US008469102B2

(12) United States Patent
Yates

(10) Patent No.: US 8,469,102 B2
(45) Date of Patent: Jun. 25, 2013

(54) SUBSEA WELLHEAD KEYLESS ANTI-ROTATION DEVICE

(75) Inventor: Chad Eric Yates, Houston, TX (US)

(73) Assignee: Vetco Gray Inc., Houston, TX (US)

( * ) Notice: Subject to any disclaimer, the term of this patent is extended or adjusted under 35 U.S.C. 154(b) by 122 days.

(21) Appl. No.: 12/916,042

(22) Filed: Oct. 29, 2010

(65) Prior Publication Data

US 2012/0103625 A1 May 3, 2012

(51) Int. Cl.
*E21B 7/12* (2006.01)

(52) U.S. Cl.
USPC ..... 166/338; 166/345; 166/368

(58) Field of Classification Search
USPC ..... 166/85.4, 368, 208; 175/57
See application file for complete search history.

(56) References Cited

U.S. PATENT DOCUMENTS 6,041,859 A 3/2000 Blades
6,695,059 B2 2/2004 Thomas et al.
2002/0144820 A1 10/2002 Thomas et al.
2004/0238219 A1 12/2004 Nichols et al.
2006/0157236 A1 7/2006 Walker et al.

FOREIGN PATENT DOCUMENTS

GB 2142402 A 1/1985
GB 2304763 A 3/1997

OTHER PUBLICATIONS

GB Search Report dated Dec. 19, 2011 from corresponding Application No. GB1118617.8.
GB Search Report dated Jan. 30, 2012 from corresponding Application No. GB1118617.8.

*Primary Examiner* — Thomas A Beach
*Assistant Examiner* — Aaron Lembo
(74) *Attorney, Agent, or Firm* — Bracewell & Giuliani LLP

(57) ABSTRACT

An anti-rotation device prevents an inner wellhead housing from rotating within an outer wellhead housing. The anti-rotation device provides cam rollers within the inner wellhead housing that wedge between opposing surfaces of the inner wellhead housing and outer wellhead housing to arrest either clockwise or counter-clockwise rotation of the inner wellhead housing. The cam rollers are circumferentially spaced apart around the inner wellhead housing.

15 Claims, 6 Drawing Sheets

Fig. 2
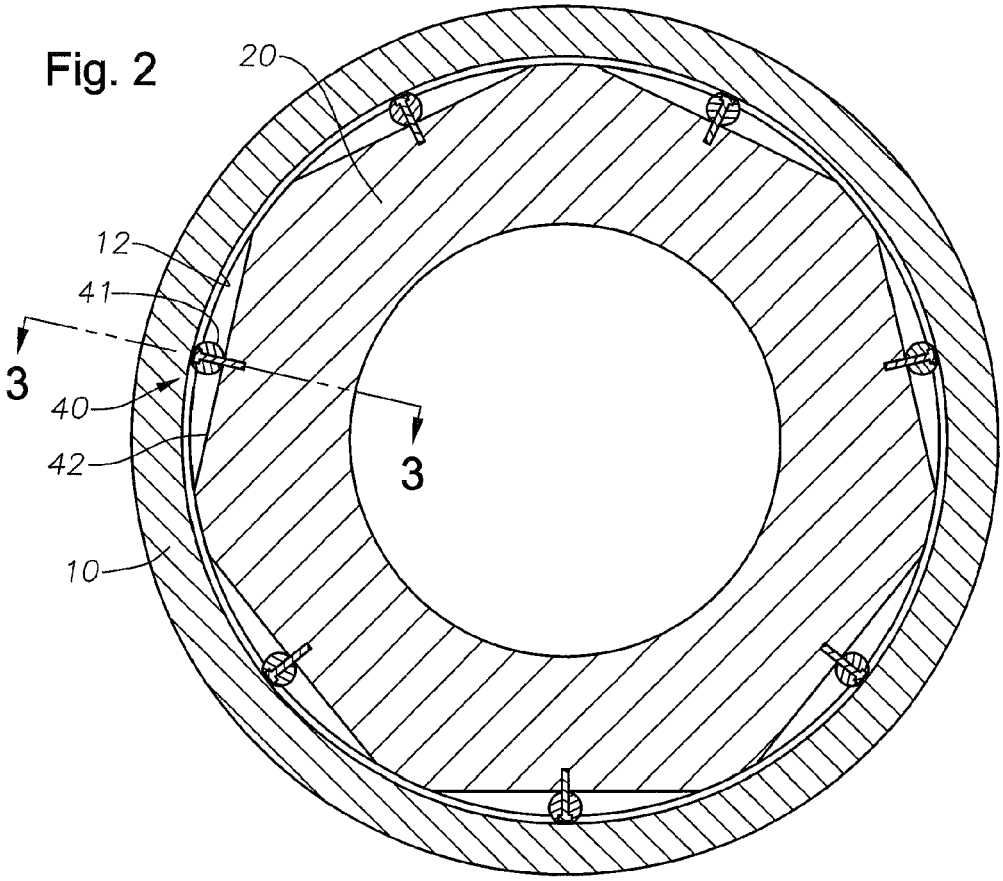
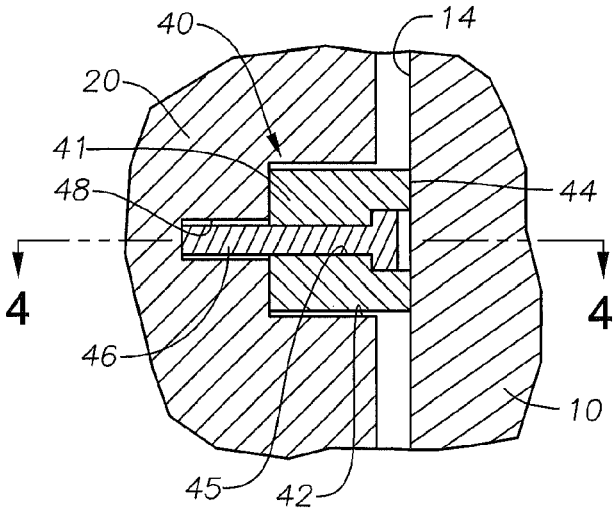
Fig. 3

SUBSEA WELLHEAD KEYLESS ANTI-ROTATION DEVICE

FIELD OF THE INVENTION

This invention relates in general to subsea well drilling, and in particular to a means for preventing an inner wellhead housing from rotating within a conductor or an outer wellhead housing when secured to the lower end of a riser that is suspended from a drilling vessel.

DESCRIPTION OF THE RELATED ART

Many subsea wells are drilled by first drilling a large diameter hole, then installing a string of conductor pipe, which has an outer wellhead housing secured to the upper end. Then, the operator drills the well to a greater depth and installs a first string of casing. An inner wellhead housing secures to the upper end of the string of casing and lands within the outer wellhead housing. The operator will then drill the well to a further depth. Typically during drilling a riser extends from the inner wellhead housing to the drilling vessel.

A floating drilling vessel can cause rotational forces on the riser. Normally, the rotation is resisted by frictional engagement of the landing shoulders of the inner wellhead housing and the outer wellhead housing. If the rotational force is high enough to cause the inner wellhead housing to begin to rotate within the outer wellhead housing, one of the casing joints below the inner wellhead housing could start to unscrew, causing a serious problem.

To address this potential problem, anti-rotation mechanisms such as keys and slots between inner and outer wellhead housings has been utilized. However, this approach has required that intricate patterns be machined in the inner bore of the outer wellhead housing, also called a low pressure housing. Due to space restrictions, machining the inner bore is difficult and time consuming. In addition, the keys and slots may fail to engage as alignment is required for their engagement.

A technique is desired that addresses the rotational problems in risers. The technique would desirably be less difficult and less time consuming than previous attempts to remedy the riser problems described above.

SUMMARY OF THE INVENTION

In an embodiment of the invention, an anti-rotation device is provided to prevent an inner wellhead housing from rotating within an outer wellhead housing. The anti-rotation device comprises at least one anti-rotational cam roller located between the inner and outer wellhead housing. In an example embodiment, an outer surface of the inner wellhead housing has a series of planar outer surface sections disposed circumferentially around the outer surface of the inner wellhead housing. The outer wellhead housing has a cylindrical surface opposite of the planar outer sections of the inner wellhead housing. A plurality of cam rollers are circumferentially spaced apart around the inner wellhead housing and face outward to come in contact with the cylindrical inner surface of the outer wellhead housing. The cam rollers are retained within a recess formed on the outer surface of the inner wellhead housing. In one embodiment, the rollers may initially be held in place by a shear pin that breaks off in response to rotation. When the inner wellhead housing begins to experience rotation, the roller will travel to a gap of decreasing size defined by the opposing surfaces of the inner wellhead housing and the cylindrical inner surface of the outer wellhead housing, thereby arresting the rotational movement of the inner wellhead housing within the first 3 degrees of rotation. The control of rotational resistance may be controlled be varying the number of anti-rotational devices, such as the cam rollers.

The invention advantageously eliminates the need to machine intricate patterns in the inner bore of the outer wellhead housing (low pressure housing). Instead only a simple cylindrical bore is turned in the inner bore of the outer wellhead housing, which is relatively easy to do. The detailed or intricate machining is thus done on the outer surface of the inner wellhead housing (high pressure housing), which can be done much quicker and easier than machining on the inside of a bore of the outer wellhead housing.

Alternatively, spheres may be used instead of rollers, and springs could be used to initially hold the cam or sphere in place rather than a shear pin. In a further alternative, the rollers could be replaced by devices that exert an equalizing force upon rotation to resist such rotation.

BRIEF DESCRIPTION OF THE DRAWINGS

FIG. 2 is a top sectional detail view of the anti-rotational mechanism of the wellhead system of FIG. 1.

FIG. 3 is an enlarged side sectional side view of a cam roller of the anti-rotational mechanism of FIG. 2.

DETAILED DESCRIPTION OF THE PREFERRED EMBODIMENTS

Figure 1:
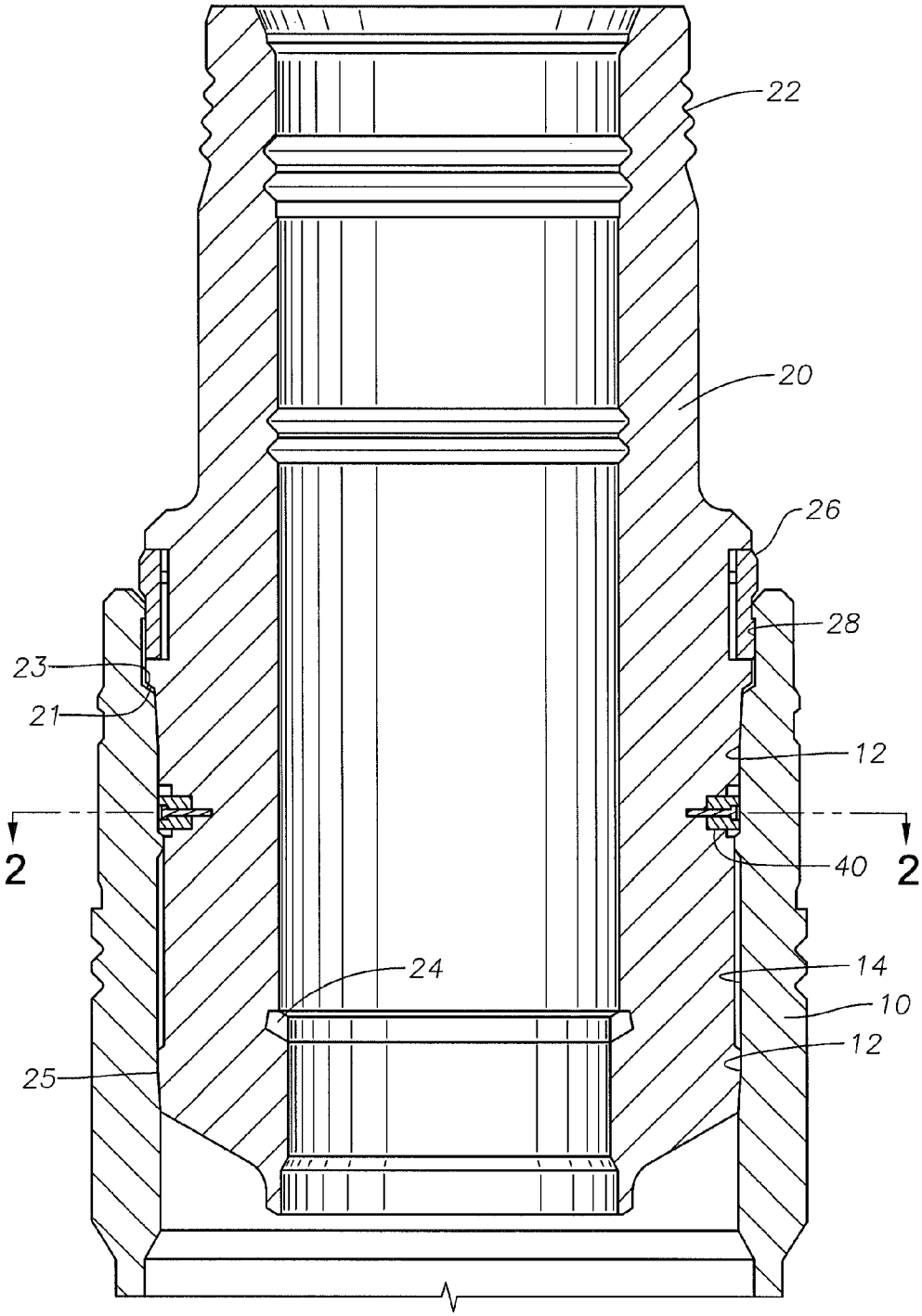
FIG. 1 is a sectional elevation view of wellhead system constructed in accordance with this invention.

Referring to FIG. 1, an outer wellhead housing 10 is shown in a side sectional view that may be installed at the sea floor. Outer wellhead housing 10 is a large tubular member secured to a string of conductor pipe or casing (not shown) that extends into the well where it is cemented in place. Outer wellhead housing 10 has an axial bore 14. In this embodiment, two tapered, axially spaced apart landing shoulders 12 are located in the bore 14 in the outer wellhead housing 10.

An inner wellhead housing 20 is shown installed within the outer wellhead housing 10. The inner wellhead housing 20 may have a threaded upper end 22 that may allow connection to a running tool (not shown). The tapered landing shoulders 12 in the bore 14 of the outer wellhead housing provide an interference fit with an outer profile of the inner wellhead housing 20 to prevent further downward movement of the inner wellhead housing 20. The inner wellhead housing 20 may be rated for higher pressures than the outer wellhead housing 10. A lower end of inner wellhead housing 20 secures to a string of casing (not shown) which extends into the well and is cemented in place. An upper end of the inner wellhead housing 20 may be connected to a string of riser (not shown) which may extend upward to a drilling vessel to thereby allow access to the inner wellhead housing 20 from the vessel. The inner wellhead housing 20 has an external downward facing conical landing shoulder 21. The landing shoulder 21 mates with and is supported by an upward-facing landing shoulder 23 formed on the interior surface of the outer wellhead housing 10. The inner wellhead housing 20 has mating shoulders 25 that engage the tapered shoulders 12 on the outer wellhead housing 10 in a wedging action to provide an interference fit. A plurality of spring biased latches 26 may be carried on the inner wellhead housing 12 which can snap outward to engage groove 28 in an upper end of the outer surface of the bore 14 to retain inner wellhead housing 20 in outer wellhead housing 10.

Continuing to refer to FIG. 1, a plurality of anti-rotational mechanisms 40 are shown positioned between the outer wellhead housing 10 and the inner wellhead housing 20 to prevent rotation of the inner wellhead housing 20 relative to the outer wellhead housing 10. The anti-rotation mechanisms 40 are circumferentially spaced apart around the inner wellhead housing 20, and shown between the two tapered shoulders 12 formed on the bore 14 of the outer wellhead housing 10. Alternatively, the anti-rotation mechanism may be formed on the bore 14 of the outer wellhead housing 10 instead of on the inner wellhead housing 20.

Referring to FIG. 2, a sectional view of the embodiment of FIG. 1 is shown taken along lines 2-2. As shown, the outer surface of the inner housing 20 is profiled with multiple channel like pockets 42 whose cross section forms planar surfaces on the outer surface of the inner housing 20. Because the bore 14 is generally circular, the pockets 42 define semicircular spaces between the planar surfaces and the outer housing 10. An anti-rotational mechanism 40 is shown set within each pocket 42. In this embodiment, each anti-rotational mechanism 40 is a cam roller 41 retained within the pocket or recess 42 formed on the inner wellhead housing 20. The roller 41 can roll along the respective surfaces of the bore 14 and the outer wellhead housing 10. Each pocket 42 has a width that provides sufficient clearance for the roller 41 to roll. Further, each pocket 42 is defined by tangential interruptions in the generally circular cross-section of the inner wellhead housing 20, as well as the bore 14 of the outer wellhead housing 10. The geometry of the pocket 42 creates a wedging action between the cam roller 41 and the pocket 42, with the curvature of the bore 14 and the flat surface of the pocket 42 resulting in maximum clearance existing at a mid-portion of the pocket 42 and diminishing at each edge of the pocket 42.

Figure 4:
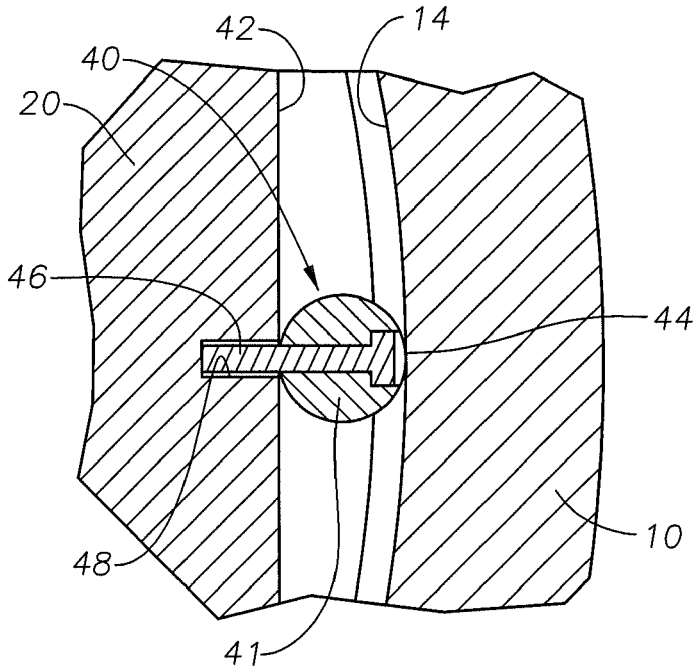
FIG. 4 is a top sectional detail view of the anti-rotational mechanism of FIG. 3 taken along the line 4-4 of FIG. 3, and shows the inner wellhead housing prior to rotation.
Figure 5:
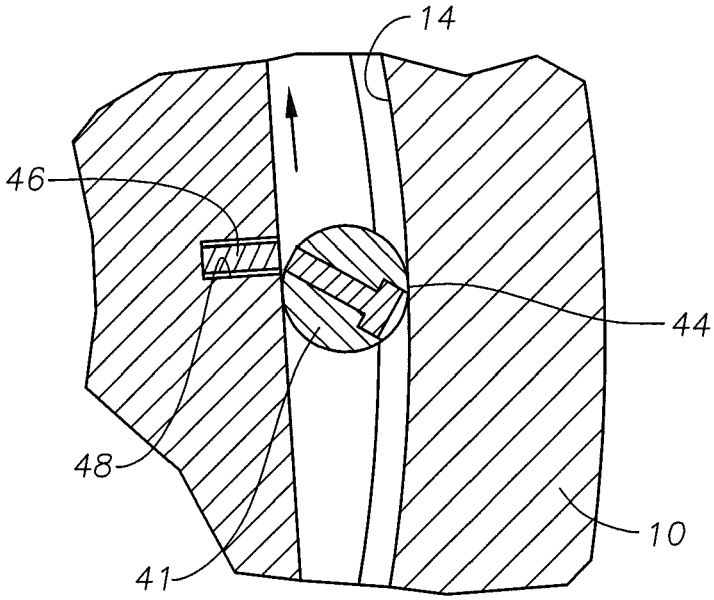
FIG. 5 is a top sectional detail view of the anti-rotational mechanism of FIG. 3 taken along the line 4-4 of FIG. 3, and shows the inner wellhead housing after slight rotation.

Referring to FIGS. 3-5, in this embodiment, each cam roller 41 may initially be held in place at the middle portion of the pocket 42 by a shear pin 46 that is attached to the inner wellhead housing 20. FIG. 3, which is taken along lines 3-3 from FIG. 2, illustrates in a side sectional view an example embodiment of a cam roller 41 made up of a cylindrical body 44 with a passage 45 formed through the body 44 for receiving the shear pin 46. The passage 45 is substantially perpendicular to an axis of the body 44 and is enlarged on an end for receiving a larger diameter section of the shear pin 46. The passage 45 is shown registering with a slot 48 formed in a bottom surface of the pocket 42 and in which an end of the shear pin 46 protrudes. In an example embodiment, the shear pin 46 prevents the cam roller 41 from rolling and falling out during installation of the inner wellhead housing 20. The shear pin 46 can break off in response to limited rotation once the inner wellhead housing 20 is installed. When the inner wellhead housing 20 begins to experience rotation relative to the outer wellhead housing 10, the roller 41 can roll along the respective surfaces of the pocket 42 and outer wellhead housing 10, but travel of the roller 41 is limited within the space where the distance between the bottom surface of the pocket and inner surface of the outer housing 10 is less than the diameter of the roller 41. This distance experiences a decreasing size defined by the curvature of the bore 14 and the flat surface of the pocket 42. In the example embodiment of FIG. 5, the roller 41 has reached a location where the distance between the bottom surface of the pocket 42 and inner surface of the outer housing 10 is less than the diameter of the roller 41, the roller 41 becomes wedged between the inner and outer housings 10, 20, thereby arresting the rotational movement of the inner wellhead housing 20 with respect to the outer wellhead housing 10. In an example embodiment, rotational movement of the inner wellhead housing 20 is limited to within approximately three degrees of rotation, as shown in FIGS. 4 and 5. The control of rotational resistance may be controlled by varying the number of anti-rotational devices 40 disposed between the inner and outer wellhead housings 20, 10.

Figure 6:
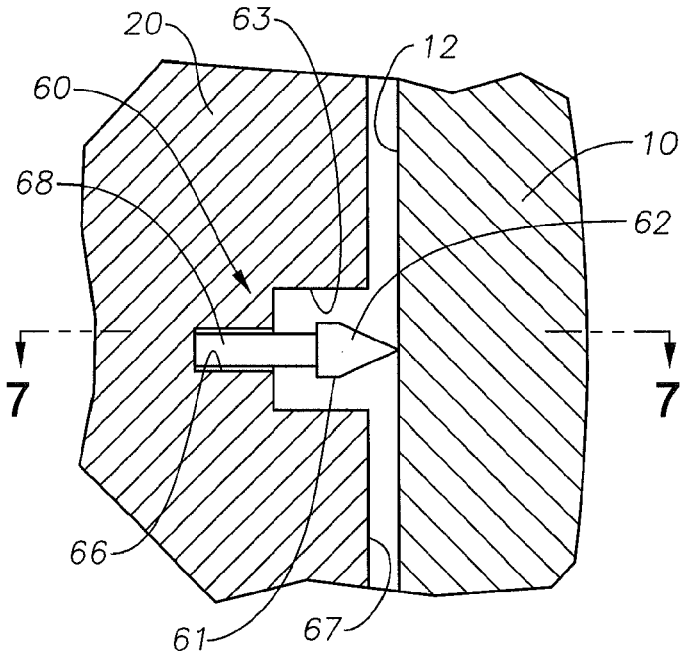
FIG. 6 is an enlarged sectional side view of an alternative embodiment of an anti-rotational mechanism with a flex lip in accordance with this invention.
Figure 7:
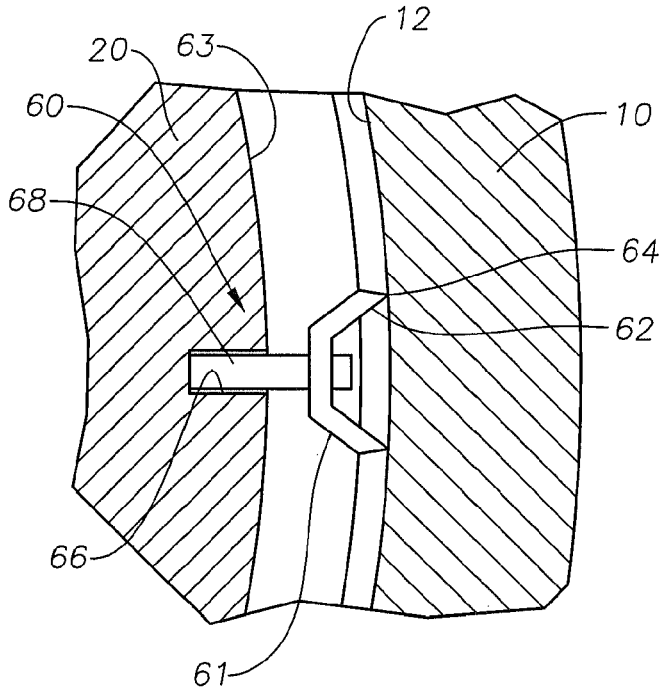
FIG. 7 is a top sectional detail view of the anti-rotational mechanism of FIG. 6 taken along the line 7-7 of FIG. 6, and shows the inner wellhead housing prior to rotation.
Figure 8:
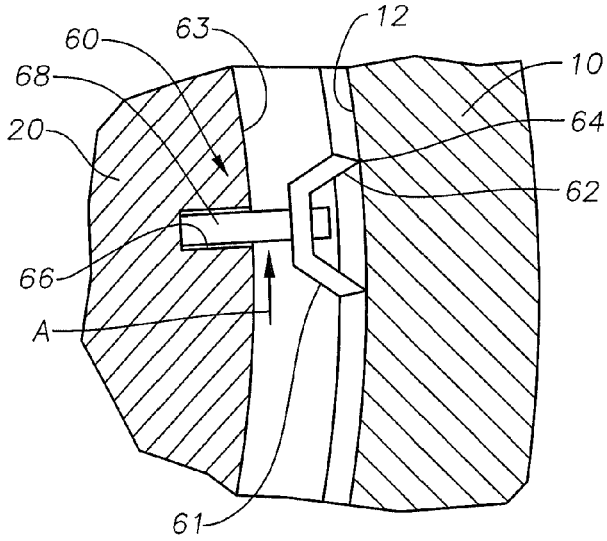
FIG. 8 is a top sectional detail view of the anti-rotational mechanism of FIG. 6 taken along the line 7-7 of FIG. 6, and shows the inner wellhead housing after slight rotation.
Figure 9:
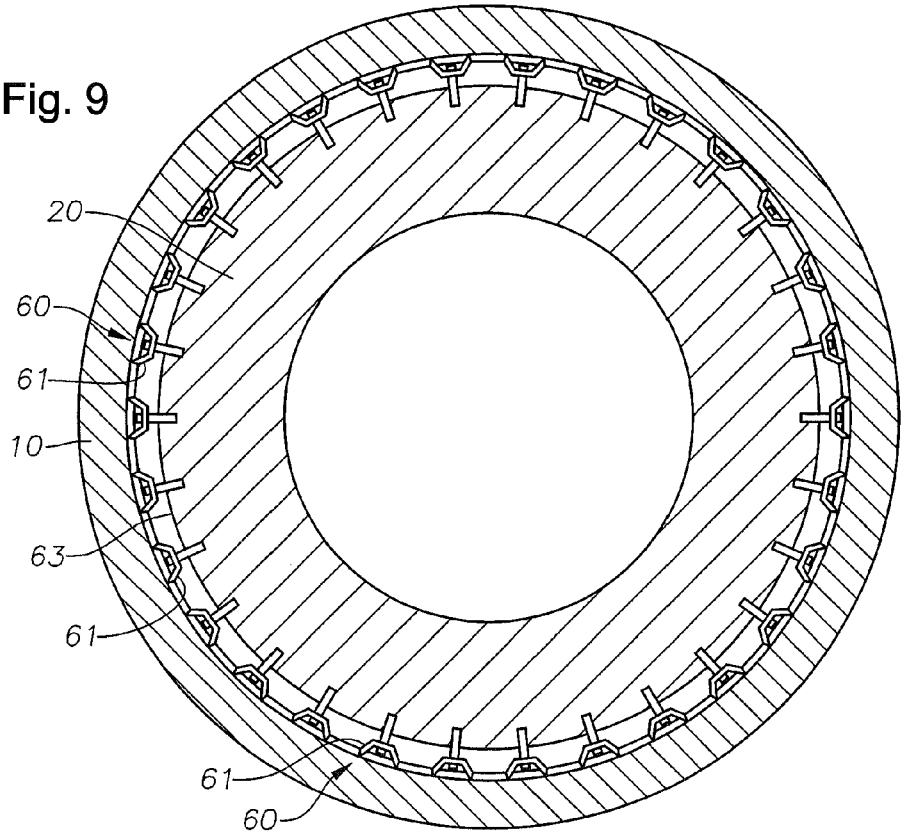
FIG. 9 is a top sectional detail view of the anti-rotational mechanism of the wellhead system of FIG. 1 with the alternative device of FIG. 6.

In an alternative embodiment, illustrated in FIGS. 6-9, an anti-rotational mechanism 60 is shown positioned between the outer wellhead housing 10 and the inner wellhead housing 20 to arrest rotation of the inner wellhead housing 20 relative to the outer wellhead housing 10. Similarly to the previously described embodiment, a plurality of anti-rotation mechanisms 60 may be circumferentially spaced apart around the outer wellhead housing 10 and between the two tapered shoulders 12 (FIG. 1) formed on the bore 14 of the outer wellhead housing 10. Referring to FIG. 6, in this embodiment shown in a side partial sectional view, the anti-rotational mechanism 60 is disposed within a pocket or recess 63 formed on the inner wellhead housing 20. The anti-rotational mechanism 60 is shown having a spring 61, that in an example embodiment may be made from a metallic material. Referring now to FIG. 7 where the anti-rotational mechanism 60 is depicted in an overhead view, the spring 61 has a middle portion that is generally aligned with the opposing surfaces of the inner and outer housings 10, 20. Depending from opposing ends of the middle portion at oblique angles are a pair of legs 62 that taper to a point 64, which engages the bore 12 of the outer wellhead housing 10. The pocket 63 has a height that provides sufficient clearance for the spring 61. Illustrated in the example of FIG. 8, as the inner wellhead housing 20 rotates, the leg 62 flexes angularly away from the middle portion and in the direction of rotation, as illustrated by arrow A. By flexing, the leg 62 exerts a force on the bore 12 via the leg point 64 to counteract the rotation, thereby arresting the rotational movement of the inner wellhead housing 20. In the example of FIG. 8, the rotational movement is arrested to within approximately three degrees of rotation. A retaining pin or fastener 68 connects to the middle portion of the spring 61 at one end and fastens to a corresponding recess 66 formed within the pocket 63. The pin 68 retains the spring 61 approximately at a middle portion of the pocket and the recess 66 provides a reaction point for the leg 64 being compressed during rotation to exert the counteracting force. In this embodiment, the plurality of springs 61 can act together, as shown in FIG. 9, to exert counteracting forces.

Figure 10:
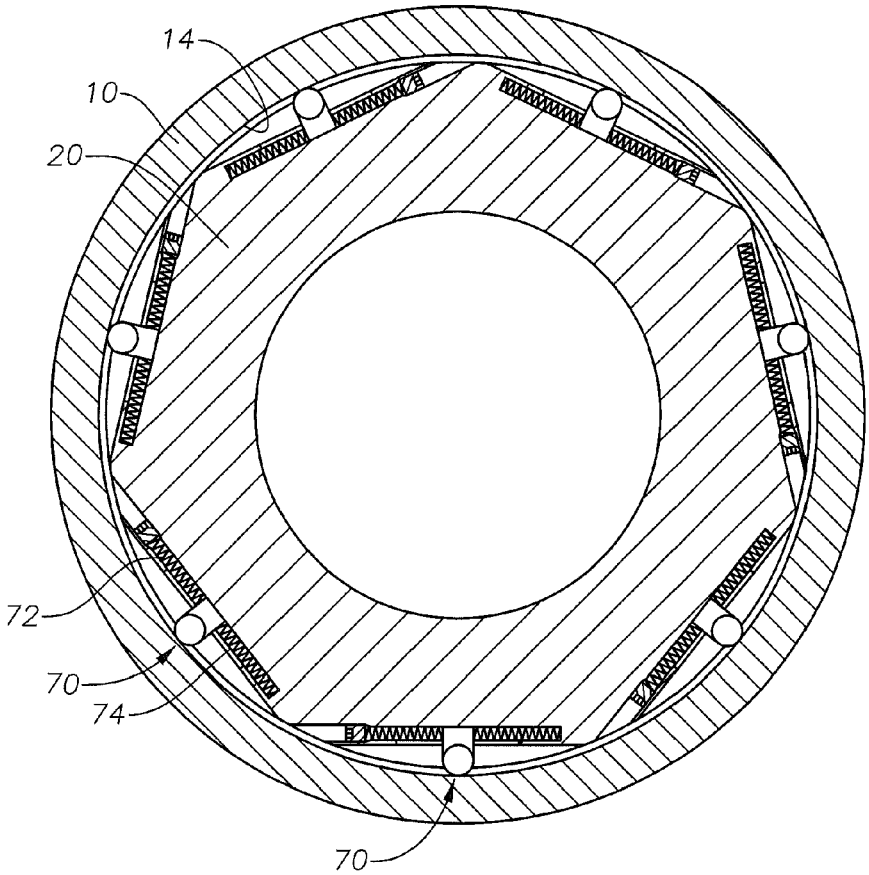
FIG. 10 is a top sectional detail view of the anti-rotational mechanism of the wellhead system of FIG. 1 with springs for centering cam rollers of FIG. 2.

In another embodiment illustrated in FIG. 10, a cam roller 70 is arranged in a similar fashion to device 40 illustrated in FIG. 1 with the exception of how it is retained. In this embodiment, the cam roller 70 is positioned between the outer wellhead housing 10 and the inner wellhead housing 20 to prevent rotation of the inner wellhead housing 20 relative to the outer wellhead housing 10. The cam rollers 70 are circumferentially spaced apart around the inner wellhead housing 20. The cam roller 70 is engaged to a pocket 74 and the bore 14 of the outer wellhead housing 10. Further, each pocket 74 has a geometry that is similar to that described in a prior embodiment in FIG. 2, which is defined by tangential interruptions in the generally circular cross-section of the inner wellhead housing 20, and by the bore 14 of the outer wellhead housing 10. The geometry of the pocket 74 creates a wedging action between the cam roller 70 and the pocket 74, with the curvature of the bore 14 and the flat surface of the pocket 74 result in maximum clearance existing at a mid-portion of the pocket 74 and diminishing at each edge of the pocket 74. Each cam roller 70 may initially be held in place at the middle portion of the pocket 74 by a spring 72 that is installed along the pocket 74 on the inner wellhead housing 20. The cam roller 70 may be connected approximately at the middle of the spring 72. The spring 72 prevents the cam roller 70 from rolling and falling out during installation of the inner wellhead housing 20. The spring 72 is not needed once the inner wellhead housing 20 is installed but will compress and extend as the inner wellhead housing 20 rotates. When the inner wellhead housing 20 begins to experience rotation relative to the outer wellhead housing 10, the roller 70 will travel to the gap or pocket 74 of decreasing size defined by the curvature of the bore 14 and the flat surface of the pocket 74, thereby arresting the rotational movement of the inner wellhead housing 20. As with the previously explained embodiment shown in FIG. 2, control of rotational resistance may be controlled by varying the number of cam rollers 70 disposed between the inner and outer wellhead housings 20, 10.

This written description uses examples to disclose the invention, including the best mode, and also to enable any person skilled in the art to practice the invention, including making and using any devices or systems and performing any incorporated methods. These embodiments are not intended to limit the scope of the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A subsea well assembly comprising:

an outer wellhead housing having a bore with a cylindrical portion;

an inner wellhead housing which lands in the bore of the outer wellhead housing;

a pocket formed along an outer circumference of the inner wellhead housing; and at least one anti-rotation assembly located in the pocket having a cylindrical body that is in rolling contact with both the outer circumference and the cylindrical portion of the bore of the outer wellhead housing, so that when one of the inner or outer wellhead housings rotates with respect to the other, the body rolls to a portion of the pocket having a smaller thickness and becomes wedged between the inner and outer wellhead housing as the body engages the cylindrical portion of the bore of the outer wellhead housing.

2. The subsea well assembly according to claim 1, further comprising a plurality of anti-rotation assemblies spaced apart circumferentially.

3. The subsea well assembly according to claim 2, wherein the anti-rotation assembly is a cam roller retained within the pocket, the cam roller being in rollable engagement with the pocket on the inner wellhead housing and the bore of the outer wellhead housing, the cam roller arrests the rotation of the inner wellhead housing when it becomes wedged into an edge of the pocket.

4. The subsea well assembly according to claim 3, further comprising a shear pin through the roller to retain the roller in the pocket, wherein the shear pin fractures in response to initiation of rotation of the inner wellhead housing.

5. The subsea well assembly according to claim 1, further comprising a spring installed along the pocket and retaining the roller in a middle portion of the spring.

6. The subsea well assembly according to claim 1, wherein the anti-rotation assembly arrests rotation within a 3 degree rotation of the inner wellhead housing.

7. A subsea well assembly comprising:

an outer wellhead housing having a bore;

an inner wellhead housing which lands in the bore of the outer wellhead housing;

a pocket formed circumferentially along an outer surface of the inner wellhead housing and having a portion with a reduced thickness; and an anti-rotation device disposed in the pocket and in close contact with an outer surface of the inner wellhead housing and an inner surface of the outer wellhead housing and with relative rotation of one of the inner or outer wellhead housings moveable in the pocket to the portion with a reduced thickness where the anti-rotation device is wedged between the inner and outer wellhead housings to couple the inner and outer wellhead housings.

8. The subsea well assembly according to claim 7, further comprising a plurality of anti-rotation devices spaced apart circumferentially.

9. The subsea well assembly according to claim 8, wherein the anti-rotation device is a cam roller retained within the pocket, the cam roller being in rollable engagement with the pocket on the inner wellhead housing and the bore of the outer wellhead housing, the cam roller arrests the rotation of the inner wellhead housing when it becomes wedged into an edge of the pocket.

10. The subsea well assembly according to claim 9, further comprising a shear pin through the roller to retain the roller in the pocket, wherein the shear pin fractures in response to initiation of rotation of the inner wellhead housing.

11. The subsea well assembly according to claim 7, further comprising a spring installed along the pocket and retaining the anti-rotation device in a middle portion of the spring.

12. The subsea well assembly according to claim 7, wherein the anti-rotation device is a spring retained within the pocket by a fastener, the spring having a pair of legs extending outward to engage the bore of the outer wellhead housing, each of the legs of the spring arrest the rotation of the inner wellhead housing when one of the legs exerts a force against the bore that counteracts the rotation of the inner wellhead housing.

13. The subsea well assembly according to claim 12, wherein the legs of the spring taper to a point.

14. The subsea well assembly according to claim 13, wherein the interface between the fastener and the pocket provide a reaction point either of the legs to exert the counteracting force.

15. The subsea well assembly according to claim 7, wherein the anti-rotation device arrests rotation within a 3 degree rotation of the inner wellhead housing.

* * * * *